United States Patent [19]

Sawyer, Jr.

[11] 4,432,771

[45] Feb. 21, 1984

[54] COMBUSTIBLE COAL/WATER MIXTURES FOR FUELS AND METHODS OF PREPARING THE SAME

[75] Inventor: Edgar W. Sawyer, Jr., Hagerstown, Md.

[73] Assignee: International Telephone and Telegraph Corporation, New York, N.Y.

[21] Appl. No.: 263,810

[22] Filed: May 15, 1981

[51] Int. Cl.[3] ..... C10L 1/32

[52] U.S. Cl. ..... 44/51; 406/197

[58] Field of Search ..... 44/51; 406/197

[56] References Cited

U.S. PATENT DOCUMENTS

| | | | |
|---|---|---|---|
| 3,907,134 | 9/1975 | Metzger | 44/51 |
| 4,104,035 | 8/1978 | Cole et al. | 44/51 |
| 4,147,519 | 4/1978 | Sawyer | 44/51 |
| 4,217,109 | 8/1980 | Siwersson et al. | 44/51 |
| 4,242,098 | 12/1980 | Braun | 44/51 |
| 4,282,006 | 8/1981 | Funk | 44/51 |

*Primary Examiner*—Jacqueline V. Howard

*Attorney, Agent, or Firm*—John T. O'Halloran; Peter C. Van Der Sluys

[57] ABSTRACT

There is disclosed a novel fuel slurry comprising a mixture of finely ground coal constituting 65 to 70 percent of the fuel, water, a wetting/dispersing agent for the coal constituting 0.5 to 5 percent of the fuel and a suspending agent for stabilizing the fuel slurry which agent constitutes a clay such as attapulgite clay in the dry, pregelled or predispersed form. Other clays can be employed as a stabilizer, as a predispersed non-gelling montmorillonate clay. If the coal slurry is to be used immediately the clay or other gelling agent is not necessary to maintain suspension stability.

16 Claims, No Drawings

COMBUSTIBLE COAL/WATER MIXTURES FOR FUELS AND METHODS OF PREPARING THE SAME

BACKGROUND OF INVENTION

This invention relates to a unique fuel and more particularly to a fuel comprising a mixture of finely ground coal, water, a wetting/dispersing agent and a suspending agent.

It has long been known that the present supply of oil is rapidly being depleted. Because of the possible future world shortage of oil and the current price increases in petroleum products, the use of oil as a source of energy has become very expensive, while as indicated above, the supply has an uncertain future. The prior art cognizant of such problems attempted to alleviate the demand for fuel oils by substituting other type of fossile fuels. The abundance of coal and its ready accessibility suggested a direct substitution of coal for oil in many applications. Hence considerable effort has been expended in formulating mixtures of oil and finely ground coal in the ratio of 50 percent oil/50 percent coal to 70 percent oil/30 percent coal.

Examples of typical formulations and techniques are depicted in U.S. Pat. No. 4,147,519 entitled COAL SUSPENSIONS IN ORGANIC LIQUIDS issued on Apr. 3, 1979 to Edgar W. Sawyer, Jr. the inventor herein and assigned to this assignee.

This Patent describes coal dust powder suspended in fuel oil and stabilized against sedimentation by an additive that makes the mixtures viscous under conditions of low shear while exhibiting low viscosity under high shear conditions to facilitate pumping through long range pipelines by the combination of a suitable surfactant with a gelling grade clay as a suspending agent.

U.S. Pat. No. 4,251,230 entitled COAL SUSPENSIONS IN ORGANIC LIQUIDS issued on Feb. 17, 1981 to E. W. Sawyer, Jr. describes a suspension of coal dust powder in fuel oil, which suspensions are also stabilized using a gelling grade clay suspending agent.

Other Patents are U.S. Pat. No. 4,062,694 entitled STABLE PARTICULATE SUSPENSIONS which issued on Dec. 13, 1977 to E. W. Sawyer, Jr. describe the use of attapulgite clay as a suspending agent for coal dust in flammable liquid hydrocarbons to formulate fuels which facilitate the removal of fly ash from the fuel assembly after burning. As indicated such prior art as well as other Patents as U.S. Pat. No. 2,397,859 entitled LIQUID FUEL AND METHOD OF PRODUCING the same issued on Apr. 2, 1946 to A. B. Hersberger, et al. attempt to substitute coal for a portion of the oil and provide a composite fuel.

U.S. Pat. No. 4,062,694 also describes coal dust-water slurries that exhibit good rheological characteristics and are useful for transporting and storing coal at a 60% concentration. The slurry is formed using coal, a wetting/dispersing agent for the coal and 1% to 3% gelling grade clay. The 60% coal concentration did not provide sufficient BTU's for the slurry to be considered a satisfactory fuel. The high water content had to be evaporated and that consumed too much of the heat content. The slurry also contributed to another problem, that being ash content. The 1 to 3% clay level contributed significantly to an unacceptable ash level.

Certain of the mixtures depicted in the prior art have been burnt successfully in certain types of furnaces.

The problem with the oil-coal mixtures is that they still contain fuel oil and do so in considerable percentages as between 50 to 70 percent oil.

It is of course understood that the ideal situation is to completely eliminate oil from the composite fuel. Many present installations are designed for powdered coal combustion and have, due to environmental considerations, been retrofitted to burn oil. However, many of the previously retrofitted installations no longer have the auxiliary room and facilities to receive, store and grind coal and therefore changing back to coal or powdered coal combustion is not possible.

It is therefore an object of the present invention to provide a fuel composition which will allow the use of powdered coal as a fuel in the above-mentioned isolated facilities, thus resulting in substantial savings in cost.

Another object is to provide an improved fuel composition employing powdered coal without any fuel oil to provide an efficient stable and economical alternate fuel composition as well as economical processes for making the composition.

SUMMARY OF THE INVENTION

This invention consists of a composition that can be utilized as a fuel which composition comprises a mixture of coal, water, wetting/dispersing agent for the coal and a suspending agent for stabilizing the slurry. Coal is present in the mixture at the 65 to 70 percent level, with the wetting/dispensing agent for the coal employed in minor, functional percentages, the suspending agents employed are natural or synthetic hydrocolloid polymers, gelling type synthetic or natural minerals, or other agents that exhibit gel properties in the water which constitutes the remainder of the composition formula.

DETAILED DESCRIPTION OF THE INVENTION

As indicated the invention consists of a composition for a novel fuel comprising a mixture of finely ground coal, water, a wetting/dispersing agent for the coal and a suspending agent for stabilizing the slurry. As will be ascertained the suspending agent may not be required if a suitable wetting/dispersing agent for the coal is used, if the coal is finely ground, and if the slurry will be used in a relatively short period of time after it has been prepared; for example, within twenty-four hours. If a longer storage time is contemplated a suspending agent is necessary.

Coal as anthracite, semi-anthracite, bituminous as well as semi-bituminous and other coal and semi-coal compositions is first crushed and ground by conventional techniques to a fairly fine powder. Examples of successful grinds which can be employed for the coal powder are 1. 95%–100 mesh, 80%–200 mesh, 65%–325 mesh.
2. 90%–100 mesh, 75%–200 mesh, 52%–325 mesh.
3. 100%–325 mesh (44 microns), 55%–26 microns.

The upper limit on the coal particle sizes is dictated by what will burn in the flame (~80 mesh). The amount of coal that can be incorporated into coal/water mixture slurries is a function of the particle size distribution, the particle morphology and the dispersing agents employed. Particle size distribution and particle shape can be established during dry processing or by post processing the slurry with various types of conventional wet-grinding equipment to achieve a change in particle size distribution and a rounding off of particle shapes.

It is desirable to incorporate a maximum amount of coal in the slurry while maintaining rheological characteristics that insure good stability and sprayability in the burner nozzle for combustion.

The maximum solids with coal appears to be about 70 to 75 percent and a satisfactory slurry can only be attained with relatively round particles, a high percentage of fine particles and a dispersing/wetting agent. For any medium to long range stability, a gelling agent that imparts gel properties to the continuous water phase is also required. The gelling agent may be omitted if the coal/water mixture is to be combusted soon after preparation and hence will not be stored.

Dispersant/wetting agents effective in this invention are low to non-foaming in water, have a structure that consists of an organic moiety that is substantive to (absorbs on) the coal surface in preference to water and a charged hydrophilic portion that is lyophilic to the continuous water phase. These agents are employed at low concentrations and collect on the coal-water interface. They displace air and water, allow the coal agglomerates to be deflocculated with mild stirring and charge up the coal particles to give minimum viscosities.

Many types of coal will only make thick pastes when 70 percent coal is blended with 30 percent water but when the dispersant/wetting agent is added, they will thin down to very low viscosity fluids when subjected to mild stirring. The dispersant/wetting agent must not interfere with any gellants that are incorporated to improve stability. Chemical materials that function well as dispersant/wetting agents for coal powders are Lomar D and PW (Diamond Shamrock Co.), sodium salts of condensed naphthalene formaldehyde sulfonates, Tamol N and SN (Rohm & Haas Co.), sodium salts of condensed naphthalene formaldehyde, sulfonates; Darvan 1 and Darvan 2 (R. T. Vanderbilt Co.), polymerized sodium salts of alkyl naphthalene sulfonic acid and sodium salts of polymerized substituted benzoid alkyl sulfonic acids respectively, and the series of Daxad wetting dispersing agents (W. R. Grace Co.) which are similar in composition to the Lomars & Darvans. Surfynol 104 (Air Products & Chemical Co.) can be used alone or in conjunction with the above-noted sulfonates as a wetting agent. Sodium lignosulfonates such as the Raylig (ITT-Rayonier Co.), the Maracarbs & Marasperses (American Can Co.), Norligs (American Can Co.) and other lignosulfonates can be used.

Stabilizing agents that maintain the coal powder in suspension in the continuous water phase act through gelling the water phase. The gelled water phase plus the suspended coal should exhibit a gel strength which reversibly breaks under shear so the coal/water mixture (C/WM) can be forced through a burner nozzle to make a burnable spray. Gelling agents that are employed are collodial grades of Wyoming bentonite, attapulgite, sepiolite, montmorillonites and synthetic smectite clays and gums and other hydrocolloids as carboxyl polymethylene (Carbopols, B. F. Goodrich Co.), carboxymethyl celluloses, alginates, xanthan gums, starches, guar gums, ethoxylated celluloses, and derivatives of these materials.

When clays are employed as suspending agents, they can be predispersed with a chemical dispersant such as tspp (tetrasodium pyrophosphate) prior to use, for example, with attapulgite clay a predispersion would be:

Water: 74.25%
TSPP: 0.75%
Attapulgite: 25.00%

The resultant predispersion is thin and pourable and can be added to the water of the coal water mixture (C/WM) prior to adding the coal dispersant and coal solids. Montmorillonite can be made up at 30 percent clay solids with 3 percent TSPP base on the clay weight.

Sepiolite can be made up in a mixture similar to the predispersed attapulgite. Wyoming bentonite is predispersed at the 10 percent clay level with 0.5 percent TSPP. Coal water mixtures containing reflocculated predispersed clays are very stable, have higher gel strengths than those containing gels made from dry clays and are pseudoplastic.

When hydrocolloids are used as stabilizers, their makedown would be by conventional means as known by those skilled in the art.

In order to gain a still clearer understanding of the composition and the problems attendant with the formulations as well as important data to enable those skilled in the art to provide the composition with a minimum of effort, examples as well as technical considerations will be discussed.

If clays such as attapulgite, sepiolite and Wyoming bentonite are used to stabilize the coal water mixture (C/WM), they can be added to the mix (1) in the final concentration as a dry clay, (2) prehydrated by pregelling in water at a higher concentration and then adding to the slurry at the desired level or (3) predispersed at a high concentration in water using a chemical dispersant and then added to the slurry as a predispersion. If option #3 is used it may be necessary to add a flocculant or dispersant neutralizer to allow the clay particles to interact and form a stabilizing gel structure.

Typical pregel compositions are:

| | Formulations in Parts by Weight | | |
|---|---|---|---|
| | 1 | 2 | 2 |
| Water | 85–90 | 85–90 | 90 |
| Clay | | | |
| Attapulgite | 10–15 | — | — |
| Sepiolite | — | 10–15 | — |
| Wyoming Bentonite | — | — | 10 |
| Total | 100 | 100 | 100 |

They are prepared by adding the water to a mixing tank, adding the clay while stirring and continuing agitation until a gel is formed and no clay lumps are present. Pregels are added to a coal/water slurry by addition of the desired aliquot to the water or to the final mix.

Typical predispersion formulations are given below:

| | Formulations in Parts by Weight | | |
|---|---|---|---|
| | 1 | 2 | 3 |
| Water | 74.25 | 74.25 | 89.50 |
| Chemical Dispersant (i.e. TSPP) | 0.75 | 0.75 | 0.50 |
| Clay | | | |
| Attapulgite | 25.00 | — | — |
| Sepiolite | — | 25.00 | — |
| Wyoming bentonite | | | 10.00 |
| | 100.00 | 100.00 | 100.00 |

They are prepared by dissolving the TSPP (tetrasodium pyrophosphate) in water in a mixing tank, adding the clay while agitating and continuing to agitate until the clay is dispersed. Predispersions of clay can be added at an early or late stage in the C/WM processing but are generally added prior to the coal. Usable chemical dispersants are TSPP, STP (sodium tripolyphosphate), Calgon, other condensed phosphate dispersants and other polyanionic organic dispersants that function as clay dispersants. Aluminum, magnesium and calcium montmorillonites of the non-swelling varieties (non-gelling grades) can be used as stabilizers in this invention. They can not be added dry or pregelled because they develop little viscosity but they will develop gel structures and viscosity if predispersed first and added as a predispersion. A typical predispersion formulation is shown below:

| | Parts by Weight |
|---|---|
| Water | 69.0 |
| TSPP | 1.0 |
| Ochlocknee Clay | 30.0 |
| | 100.0 |

It is prepared as described above and added in the same manner as the other predispersions.

All predispersed clay-stabilized C/WM's should be examined to determine if a dispersant neutralizer is necessary. If a very clean coal is used and the viscosity and gel strength of the final C/WM is low, neutralizers such as hydrated lime, ammonium nitrate, aluminum sulfate, etc., can be added to the final mix to thicken it by floccing the clay component. With dirtier coals there is enough clay present to absorb some of the dispersant; thus, a gel is produced without the addition of a neutralizer.

Normally the efficiency of clay utilization in suspension stabilization is predispersed>pregelled>>dry addition. The same efficiency of usage has been noted in C/WM's.

Examples of the utilization of this invention are shown as follows using a finely ground (80% minus 200 mesh) Kentucky bituminous coal and medium-shear (Sterling Multimixer) processing. EXAMPLE 1

| | Coal-Water | | |
|---|---|---|---|
| | A | B | C |
| Coal | 70% | 60% | 55% |
| Water | 30% | 40% | 45% |
| | 100% | 100% | 100% |

1-A This mix was too thick and dilatant.
1-B Thick but pourable. Settled rapidly.
1-C Good consistency but settled out immediately.

EXAMPLE 2

| | Water, Coal, Clay | | | |
|---|---|---|---|---|
| | A | B | C | D |
| Water | 29% | 29.5% | 39% | 44.5% |
| Attapulgite | 1% | 0.5% | 1% | 0.5% |
| Coal | 70% | 70.0% | 60% | 55.0% |
| | 100% | 100.0% | 100% | 100.0% |
| Storage Stability Brookfield Visc. (cps) | | | | |
| Initial, 10/100 RPM | Too thick | Too thick | 10,000/8000 (thick) | 2400/620 |
| 24 hrs., 10/100 RPM | — | — | Too thick | 3000/1250 Some settling |

Example 1 formulation results indicate that high coal concentrations (60% to 70%) are thick in consistency and tend to settle. At 55% coal-45% water, they are thinner and settle more rapidly as was the case with 1C.

When attapulgite clay was added, as shown in Example 2, slurries got thicker (2A, 2B and 2C) but the clay stabilized lower concentrations of coal in water in Formulation 2D.

Since 55% coal in water is less desirable than 70% coal in water for combustion purposes, evaluations of coal dispersants/wetting agents were made. An ethoxylated castor oil (Surfactol 365), an acetylenic alcohol (Surfynol 104E), an ethoxylated acetylenic alcohol (Surfynol 465) and citric acid were tried and were not good coal dispersant/wetting agents. Lignosulfonates and salts of naphthylene formaldehyde sulfonate condensates were good dispersant/wetting agents. They were evaluated with the formulations shown in Example 3 where Raylig 260LR is a 50% sodium lignosulfonate solution, Lomar D is a sodium salt of a condensed naphthylene sulfonate. TSPP is tetrasodium pyrophosphate and Calgon is the sodium salt of a condensed phosphate dispersant.

EXAMPLE 3

| | Water, Coal, Dispersants | | | |
|---|---|---|---|---|
| | A | B | C | D |
| Water | 26% | 29.5% | 29.5% | 29.5% |
| Dispersant | | | | |
| Raylig 260LR | 4% | — | — | — |
| Lomar D | — | 0.5% | — | — |
| TSPP | — | — | 0.5% | — |
| Calgon | — | — | — | 0.5% |
| Coal | 70% | 70.0% | 70.0% | 70.0% |
| | 100% | 100.0% | 100.0% | 100.0% |
| Storage Stability Brookfield Visc. (cps) | | | | |
| Initial 10/100 RPM | 1900/1210 | 3600/1740 | Too thick | Too thick |
| 24 hrs. 10/100 RPM | 1200/750 | 3500/200 | — | — |
| 48 hrs. | Some settling | Some settling | — | — |

In Example 3, formulations and evaluation results are shown for water-coal-dispersant compositions. Using Raylig 260LR or Lomar D the powdered coal dispersed in water at the 70% level and low viscosities resulted. These two compositions, Formulations 3A and 3B were attractive viscosity-wise but after 24 hours storage showed a slight amount of settling. This resulted from (1) the large coal particles and (2) the fact that no stabilizing gelling agent was present.

Note: TSPP and Calgon did not disperse the coal in water.

Formulations in Example 4 were made to show the effect of dry clay incorporations into Example 3 compositions.

EXAMPLE 4

| | Water, Coal, Dispersant, Dry Clay | | | | | |
|---|---|---|---|---|---|---|
| | A | B | C | D | E | F |
| Water | 25.5 | 30.5 | 29.0 | 29.0 | 28.9 | 33.9 |
| Dispersant: | | | | | | |
| Raylig 260LR | 4.0 | 4.0 | — | — | — | — |
| Lomar D | — | — | — | — | 0.6 | 0.5 |
| Calgon | — | — | 0.5 | — | — | — |
| TSPP | — | — | — | 0.5 | — | — |
| Coal | — | — | — | 0.5 | — | — |
| Attapulgite | 0.5 | 0.5 | 0.5 | 0.5 | 0.5 | 0.6 |
| Total | 100.0 | 100.0 | 100.0 | 100.0 | 100.0 | 10.00 |
| Storage Stability | | | | | | |
| Brookfield Visc. (cps) | | | | | | |
| Initial | | | | | | |
| 10/100 RPM | 12,000/4150 | 3000/1300 | 12,000/3600 | Too Thick | 7000/1880 | 4000/1940 |
| 24 hrs. | | | | | | |
| 10/100 RPM | 10,500/4150 No sed. | 2300/1510 No sed. | 10,000/3750 No. sed. | — | 4100/2000 | 4100/1260 No sed. |
| 1 Week | | | | | | |
| 10/100 RPM | — | — | Settling & Sed. | — | — | 2150/930 No sed. |
| 2 Weeks | | | | | | |
| 10/100 RPM | — | — | — | — | — | — |
| 1 Month | | | | | | |
| 10/100 RPM | 11,000/4550 No sed. | 5000/2040 Sl. sed. | — | — | — | — |

By referring to viscosity results it is noted that attapulgite clay substantially increased the viscosity of the Raylig formulation (4A) but stabilized it against settling. The clay had less of an adverse viscosity effect with the Lomar D formulation, 4E, and it maintained its lower viscosity while remaining stable. Clay in the TSPP- and Calgon-dispersed formulations, 4C and 4D, resulted in compositions that were excessively thick. These formulations were all at the 70% coal level. When the coal concentration was decreased to 65% as in 4B and 4F, much lower viscosities resulted and the formulations were stable.

Since normally predispersed attapulgite is more efficient as a suspending agent than dry clay, a 25% predispersion was made up and evaluated in the 70% coal slurry formulations shown in Example 5. Note that the clay is shown as percentage of PD clay and must be divided by four to determine dry clay content.

When the formulations and results from Example 5 are considered, it is noted that the amount of predispersed (PD) clay required to stabilize the 70% coal slurries was decreased substantially over that shown in Example 4—the 0.75% PD clay of Formulation 5-A is actually 0.19% dry clay. Raylig 260LR plus PD clay gave formulations that thickened on storage. Lomar D, Lomar PW and Darvan #1, all sodium salts of naphthylene formaldehyde sulfonate condensates, plus PD clay formulations had good viscosities and stabilities.

To demonstrate the effects of post processing these slurries, Formula F from Example 5 was made up on a larger scale in a one-gallon Waring Blender. It was then ball milled for 5, 10 and 15 minutes as shown in Example 6.

EXAMPLE 5

| | Water, Coal, Dispersant, Predispersed Attapulgite | | | | | |
|---|---|---|---|---|---|---|
| | A | B | C | D | E | F |
| Water | 25.25% | 26.4% | 28.71% | 28.71% | 28.65% | 28.65% |
| Dispersant | | | | | | |
| Raylig 260LR | 4.0 | 3.0 | — | — | — | — |
| Lomar D | — | — | 0.54 | — | — | 0.6 |
| Lomar PW | — | — | — | 0.54 | — | — |
| Darvan #1 | — | — | — | — | 0.6 | — |
| PD Clay (25%) | 0.75 | 0.6 | 0.75 | 0.75 | 0.75 | 0.75 |
| Coal | 70.00 | 70.0 | 70.00 | 70.00 | 70.00 | 70.00 |
| Total 100.00% | 100.0% | 100.00% | 100.00% | 100.00% | 100.00% | |
| Storage Stability | | | | | | |
| Brookfield Visc. (cps) | | | | | | |
| Initial 10/100 RPM | 4800/2220 | 7800/2720 | 4800/2100 | 5200/2220 | 7400/2640 | 5200/2100 |
| 24 hrs. 10/100 RPM | 5600/3240 | 6600/2500 | — | 4400/2180 | 5800/2580 No. sed. | 4200/2160 No. sed. |
| 3 days 10/100 RPM | 12,500/3400 No. sed. | 7200/3760 No. sed. | 4600/2020 No. sed. | 4400/1960 No. sed | 7200/3760 No. sed. | 4600/2020 No. sed. |
| 4 days 10/100 RPM | — | 7200/3560 No. sed. | — | — | — | — |
| 1 Week 10/100 RPM | — | 7600/2940 No. sed. | 4400/2000 No. sed. | 3500/1880 Very light sediment | 5200/2280 Sl. sed. | 4000/1940 |
| 1 Month | — | 12,000/3900 | 5000/2500 | 4000/1980 | 5200/2600 | — |

-continued

| | Water, Coal, Dispersant, Predispersed Attapulgite | | | | | |
|---|---|---|---|---|---|---|
| | A | B | C | D | E | F |
| 10/100 RPM | | No sediment | No sediment | No sediment | Sl. sediment | |

EXAMPLE 6

Effect of Ball Milling to Change Particle Size Distribution and Shape.

| A. Starting formula - Waring Blender processed. | |
|---|---|
| Water | 28.65% |
| Lomar D | 0.60 |
| PD Clay (25% clay) | 0.75 |
| Coal | 70.00 |
| | 100.00% |

Storage Stability
Viscosities after Ball Milling (Brookfield Visc., cps)

| Ball Milling Time, min. | 0 | 5 | 10 | 15 |
|---|---|---|---|---|
| Initial 10/100 RPM | 1500/580 | 950/925 | 3900/870 | Paste |
| 24 hrs. 10/100 RPM | — | — | 2000/1280 | — |
| 36 hrs. 10/100 RPM | — | — | 1950/710 No sed. | — |
| 1 Week 10/100 RPM | — | — | 2000/1460 No sed., Trace SN* | — |

*SN = supernatant liquor

Ten minute ball milling of formulation 6A resulted in an increase in viscosity over the control but a much smoother looking slurry. Note that the viscosity dropped and became quite stable.

Montmorillonite clay of the non-gelling type can also be used to stabilize C/WM. To demonstrate this a 30% predispersion of montmorillonite clay (PDM) was made up using the formula previously described. The PDM was used in the following 70% coal slurries.

EXAMPLE 7

| | A | B |
|---|---|---|
| Water | 20% | 13% |
| Raylig 260LR | 5 | 7 |
| PDM (30%) | 5 | 10 |
| Coal | 70 | 70 |
| | 100% | 100% |

Storage Stability
Brook. Visc. (cps)

| | | |
|---|---|---|
| Initial, 10/100 RPM | 5600/1940 | 9800/2400 |
| 24 hrs., 10/100 RPM | 6400/2760 | 10,500/3650 |
| 36 hrs., 10/100 RPM | 6500/2400 | 9500/3100 |
| 1 Week, 10/100 RPM | 6600/3000 | 9600/3500 |
| 1 Month, 10/100 RPM | 13,000/4100 | 14,500/4250 |
| | No settling No sediment | No settling No sediment |

The use of 5% of 30% PDM is equivalent in amount to 1.5% dry clay.

It can be concluded from these formulation data and stability results that stable 70% coal-in-water slurries can be made up by employing lignosulfonate dispersants at the 1% to 5% level or sodium salts of naphthylene formaldehyde sulfonate condensate dispersants at the 0.5 to 2.0% level plus attapulgite clay in the dry, pre-gelled or predispersed form as a stabilizer or predispersed non-gelling montmorillonite clay as a stabilizer. If the coal slurry is to be used immediately the clay or other gelling agents will not be necessary to maintain suspension stability.

I claim:

1. A combustible fuel slurry comprising:
   from 65–70% coal powder in particulate form and having a rounded particle shape;
   from 0.5 to 5% by weight of a wetting/dispersing agent selected to be low to nonfoaming in water and having a structure that consists of an organic portion that absorbs on the surface of said coal particles with said agent having a charged hydrophilic portion that is lyophilic to the continuous water phase;
   a clay stabilizing composition in the form of a predispersion comprising a clay stabilizer, a clay dispersant and water wherein the amount of clay stabilizer in the fuel slurry is from 0.15 to 0.8% by weight; and
   the remainder of said fuel being water, whereby the clay stabilizer, when added to the fuel slurry, provides a stabilizing gel structure for the slurry.

2. A combustible fuel slurry as described in claim 1 wherein the clay dispersant is selected from a group consisting essentially of tetrasodium pyrophosphate, sodium tripolyphosphate condensed phosphate dispersants and sodium salts thereof and polyanionic organic dispersants that function as clay dispersants.

3. A combustible fuel slurry as described in claim 1 wherein said clay stabilizer is selected from a group consisting essentially of bentonite, attapulgite, sepiolite and montmorillonite.

4. A combustible fuel slurry as described in claim 1, wherein the predispersion comprises from 10 to 30% by weight clay stabilizer, 0.5–1.0% by weight clay dispersant and the remainder being water.

5. A combustible fuel slurry as described in claim 1, additionally including a neutralizer for floccing the dispersed clay component.

6. A method of making a combustible coal/water fuel slurry, comprising the steps of:
   preparing a stabilizing composition by adding from 10–15% by weight of a clay selected from the group consisting of attapulgite, sepiolite and Wyoming bentonite to water while both stirring and agitating to form a pregel;
   adding from 0.5–5% by weight of a wetting/dispersing agent for coal to the water of the fuel slurry;
   adding said stabilizing composition to said slurry water; and
   adding 65–70% by weight coal while stirring to provide a gelled fuel.

7. A method of making a combustible coal/water fuel slurry, comprising the steps of:
   preparing a stabilizing composition by adding a clay dispersant and a clay stabilizing agent to water while agitating and continuing to agitate until the clay stabilizing agent is dispersed to form a predispersion;

adding from 0.5 to 5.0% by weight of a wetting/dispersing agent for coal to the water of the fuel slurry;

adding said stabilizing composition to said slurry water; and adding 65 to 70% weight coal while stirring to provide a gelled fuel.

8. A method of making a combustible coal/water fuel slurry as described in claim 7, wherein the wetting/dispersing agent is selected from salts of condensed napthylene formaldehyde sulfonates, polymerized salts of alkyl naphthylene sulfonic acid, salts of polymerized substituted benzoid alkyl sulfonic acids, salts of lignosulfonates.

9. A method of making a combustible coal/water fuel slurry as described in claim 7, wherein the clay dispersant is selected from a group consisting essentially of tetrasodium pyrophosphate, sodium tripolyphosphate condensed phosphate dispersants and sodium salts thereof, and polyanionic organic dispersants that function as clay dispersants.

10. A method of making a combustible coal/water fuel slurry as described in claim 7, wherein the clay stabilizing agent is selected from a group consisting of bentonite, attapulgite, sepiolite and montmorillonite.

11. A method of making a combustible coal/water fuel slurry as described in claim 7, wherein the stabilizing composition is prepared by adding 10 to 30% by weight clay stabilizing agent and 0.5 to 1.0% by weight clay dispersant so that the total clay stabilizing agent in the fuel slurry is from 0.2 to 0.8% by slurry weight.

12. The fuel slurry according to claim 1 wherein said particle size is about 80 mesh.

13. The fuel slurry according to claim 1 wherein said wetting/dispersing agent is selected from the group consisting of sodium salts of condensed naphthylene formaldehyde sulfonates, polymerized sodium salts of alkyl naphthylene sulfonic acid, sodium salts of polymerized substituted benzoid alkyl sulfonic acids and sodium lignosulfonates.

14. The method according to claim 7 including the further step of adding a neutralizer after stirring to thicken the final mix.

15. The method according to claim 14 wherein said neutralizer is selected from hydrated lime, ammonium nitrate, aluminum sulfate.

16. The method according to claim 6 wherein said coal powder is bituminous coal powder of 200 mesh diameter particles.

* * * * *